United States Patent [19]

Hinterholzer

[11] Patent Number: 5,024,551

[45] Date of Patent: Jun. 18, 1991

[54] RESILIENT SLALOM GATE

[76] Inventor: Hans Hinterholzer, Post Box 118, N-1545 Hvitsten, Norway

[21] Appl. No.: 453,949

[22] Filed: Dec. 20, 1989

[51] Int. Cl.[5] ..... E01F 9/00

[52] U.S. Cl. ..... 404/10; 40/603; 40/608; 40/218; 40/604; 52/113; 52/165; 116/173

[58] Field of Search ..... 404/10; 280/819, 820, 280/821; 40/604, 608, 603, 617, 606, 607, 218; 116/173, 174, DIG. 4; 248/156, 160; 52/113, 155, 165

[56] References Cited

U.S. PATENT DOCUMENTS

| | | | |
|---|---|---|---|
| 3,279,133 | 10/1966 | De Korte | 404/10 |
| 4,103,445 | 8/1978 | Smith et al. | 40/603 |
| 4,105,190 | 8/1978 | Curtis | 40/617 |
| 4,161,723 | 7/1979 | De Vittori | 362/431 |
| 4,270,873 | 6/1981 | Laehy et al. | 256/1 |
| 4,491,438 | 1/1985 | Berutti | 404/10 |
| 4,588,324 | 4/1986 | Goellner | 404/10 |
| 4,599,012 | 7/1986 | Kugler et al. | 404/10 |
| 4,636,109 | 1/1987 | Clausen et al. | 404/10 |
| 4,702,639 | 10/1987 | Hinterholzer | 404/10 |
| 4,871,279 | 10/1989 | Hinterholzer | 404/10 |

*Primary Examiner*—Ramon S. Britts
*Assistant Examiner*—Roger J. Schoeppel
*Attorney, Agent, or Firm*—Hugh Adam Kirk

[57] ABSTRACT

A pair of parallel slalom posts connected by a flag, which flag is connected by an elastic strip with one of the posts, and the other post is provided with a tilting joint. Thus, if a skier touches the post with the tilting joint, the post can bend without damage to the flag.

15 Claims, 2 Drawing Sheets

RESILIENT SLALOM GATE

BACKGROUND OF THE INVENTION

Conventionally, the flag on a slalom gate is firmly connected by strips with both gate posts.

Gate posts with tilting joints are disclosed in U.S. Pat. Nos. 4,270,873 issued June 2, 1981 and 4,588,324 issued May, 13, 1986, and German Offenlegungsschrift No. 28 14 896.

Furthermore, disc-like anchoring means for anchoring the posts in snow or ice are disclosed in applicant's U.S. Pat. No. 4,871,279 issued Oct. 3, 1989.

When a skier or race runner touches one of the gate posts of a conventional slalom gate, there is danger that the respective gate post will break or cause injury to the skier, tear out one or both of the posts, and/or tear the flag or its fastening means to the posts. These damages occur even if one of the posts is provided with a tilting joint and the other post is not.

SUMMARY OF THE INVENTION

The slalom gate of this invention includes a pair of parallel gate posts and a flag connected between the posts near the upper ends thereof. The improvement of this invention is providing elastic means for connecting the flag to at least one of said posts and particularly when the other of said posts has a tiltable joint. Thus the elastic connection permits the flag to yield to winds without tearing, and to permit the tilting of a tiltable joint post without damaging the flag or other post with immediate recovery of the gate to its normal position after being flexed.

The tiltable joint on the post is usually located near the lower end thereof just above the ground, which joints permits the post to be bent from its normal vertical position to a position horizontal or parallel to the ground. Thus the elastic means for connecting the flag to the other post must be sufficiently long or extensible to permit this maximum movement of the tiltable post.

The flag, usually rectangular in shape, is preferably provided with a receptacle, pocket or sleeve along one of its vertical edges so that it can easily be slipped on and off the upper end of the posts with the tiltable joint. The other vertical edge of the flag is provided at its upper and lower corners with means such as rings for fastening the elastic strips or cable means. This elastic means extends through holes in and down through the other end and hollow post. These holes in the hollow post are adjacent the corners of the flag. The longitudinal elastic means that extends down through the center of the hollow post is fastened near its lower end by either an anchoring plate, bushing, or around a pulley. Furthermore, elastic may be also attached between the two corners of the flag inside the post. However, this is not a necessary elastic connection. The length of the elastic means thus permits maximum movement of the other post of the pair without tearing the flag that is connected between the two posts.

If desired, either or both of the posts may be provided with disc anchoring means which protrude radially outwardly from the lower pointed end of the post after it has been struck into the ground, snow or ice.

The resilient slalom gate of this invention may be used for all conventional slalom gates including for downhill running, the super-G-slalom, and for slalom racing.

OBJECTS AND ADVANTAGES

It is an object of this invention to provide a simple, effective, efficient, and economic resilient slalom gate which when touched by a skier or racer, it will yield without damage either to the skier or to the gate, and the tilting of the gate will recover immediately into its normal position ready for the next skier.

Another object is to produce such a resilient slalom gate which maintains the flag stretched and will not tear the flag or its connections when a tiltable post is blown by strong winds or tilted even to touching the ground.

A further object is to produce such a resilient flexible slalom gate in which the flag may easily be removed or detached from one of the posts by a skier, if necessary, to prevent damage or injury.

A still further object of this invention is to eliminate the dreaded stroke effect and lashing effect of prior known slalom gates.

BRIEF DESCRIPTION OF THE DRAWINGS

The above mentioned and other features, objects and advantages, and a manner of attaining them are described more specifically, below by reference to embodiments of this invention shown in the accompanying drawings, wherein.

DETAILED DESCRIPTION OF PREFERRED EMBODIMENTS

Figure 1:
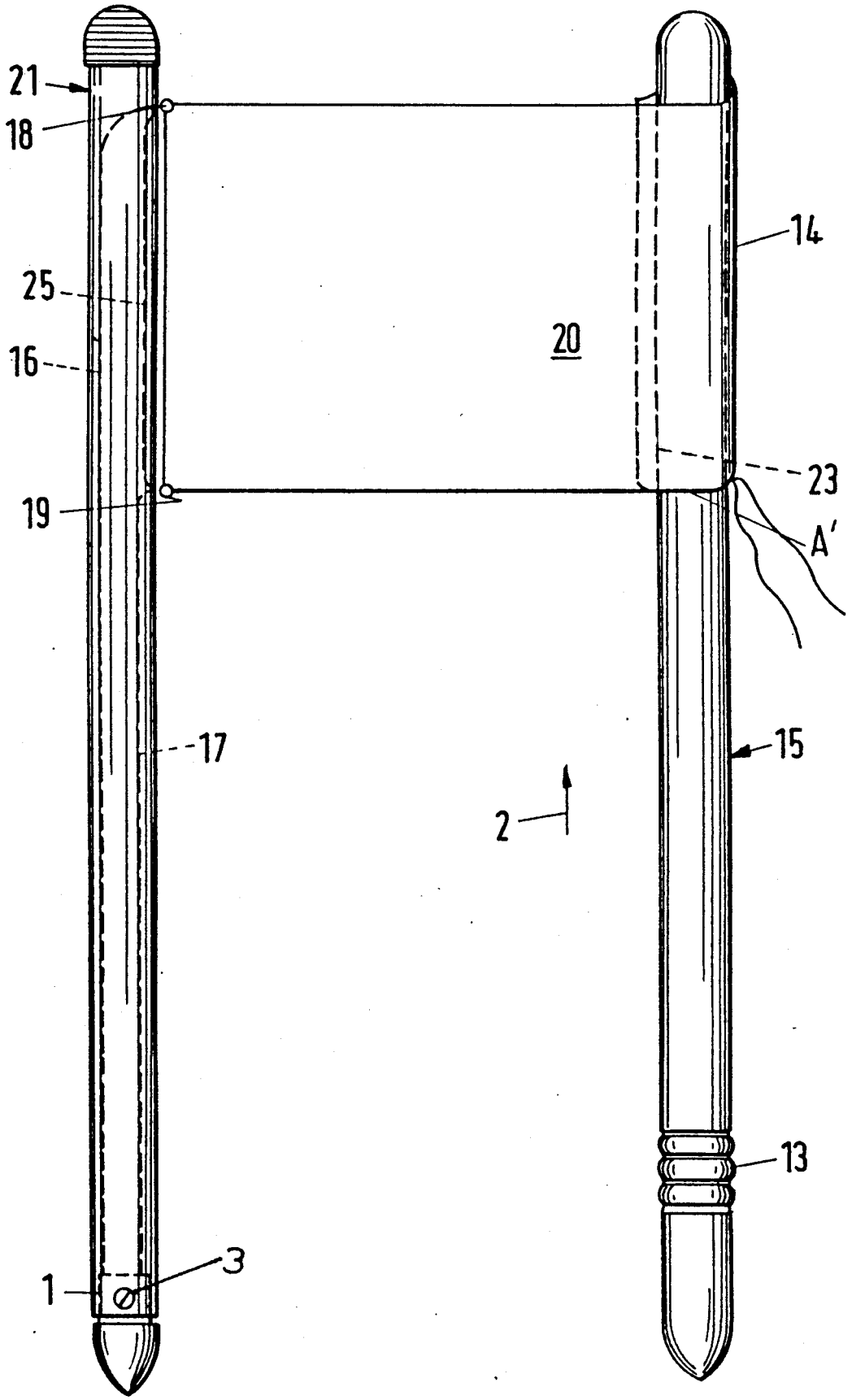
FIG. 1 is a side view of a slalom gate according to a preferred embodiment of this invention.

Referring first to the embodiment shown in FIG. 1, the slalom gate comprises a pair of spaced parallel vertical posts 15 and 21 connected together near their upper ends by a flag 20. The post 15 may be solid or hollow, as desired, and is provided near its lower end with a tiltable or resilient joint 13 which permits the post 15 to bend from its normal vertical position to a substantially horizontal position orthogonal to its lower tip end which is anchored in the snow or ice.

The other post 21 is hollow and contains holes adjacent the rings 18 and 19 at the upper and lower corners of the vertical edge of the rectangular flag 20 adjacent this post. Connected to these rings 18 and 19 are separate or a single elastic cord 16, 17. This cord means extends down through the hollow post and is anchored to the bushing 1 which may be held in place by a screw 3 in the lower end of the hollow post 21. There is also shown an elastic cord 25 connected between the rings 18 and 19, which elastic cord 25 also is inside the hollow post 21, but this further elastic cable 25 is usually not necessary. The other vertical edge of the flag 20 is herein shown to have a sleeve portion 14 formed, such as by hem stitching at 23, along the outer edge of the flag 20. This sleeve 14 acts as a pocket or receptacle for connecting the flag 20 to the post 15, as well as being sufficiently loose to slip easily over the top of the post 15. Thus the flag 20 can easily be removed or pushed off the post 15 in the event a skier or runner gets entangled with the gate and needs to free himself therefrom. This is accomplished by pushing the lower edge A' of the flag upwardly in the direction of the arrow 2 shown in FIG. 1. Similarly, if a skier touches the post so that he contacts the lower edge A' of the flag 20, such will automatically push the flag off of the post 15 without tearing the flag 10.

Figure 2:
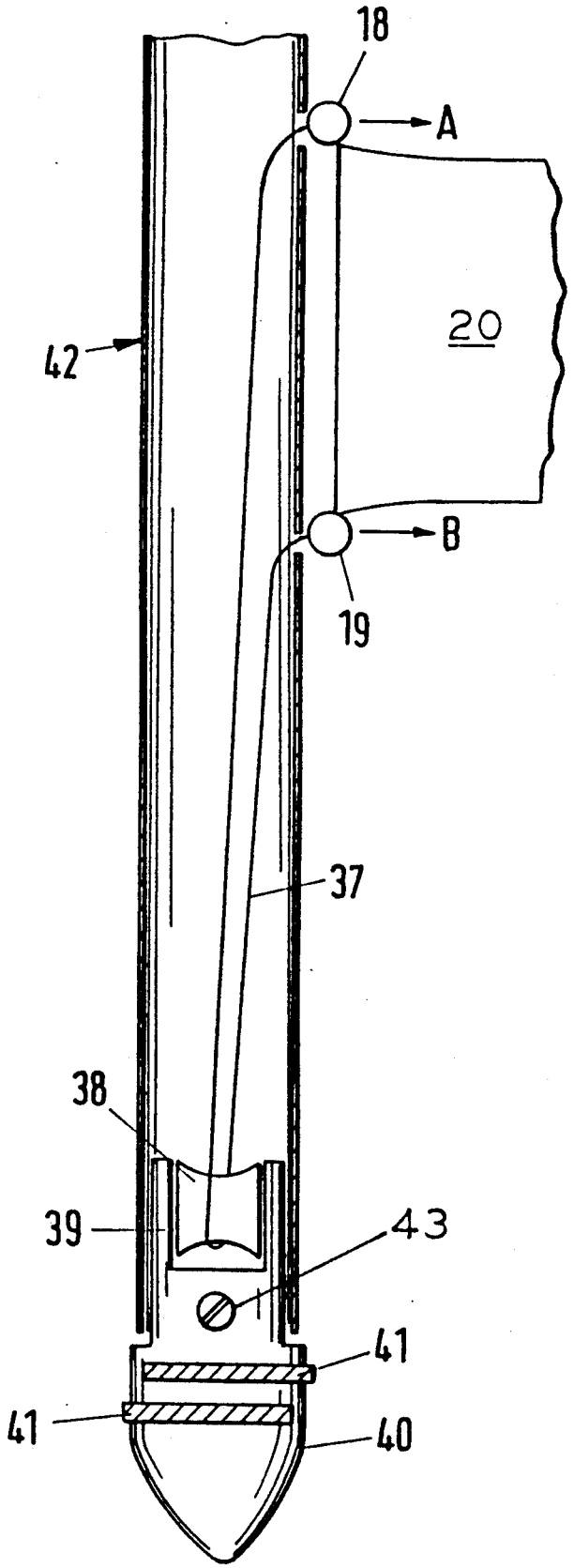
FIG. 2 is an enlarged vertical sectional view of another embodiment of the hollow post shown at the left in FIG. 1.

Referring now to the embodiment shown in FIG. 2, the same parts thereof have the same reference characters. In this embodiment the holes in the hollow post 42 are shown with the elastic cable or cord 37 directly connected to the rings 18 and 19, which rings are connected also to the corners of the flag 20 in the directions A and B. In this embodiment the single elastic cable 37 passes over a roller 38 mounted in a bushing 39 of lower tip portion 40 which may be fastened to the post 42 by screw 43. This portion 40 also is shown to have a pair of radical extendable anchoring discs 41 which, when the pole is rotated, extend radially outwardly into the snow. Such anchoring means are described in the above mentioned Hinterholzer U.S. Pat. No. 4,871,279 issued Oct. 3, 1989.

Although this description is directed to a tiltable post from which the flag may be easily detached, and a hollow post in which an elongated elastic means is connected to the flag, it is to be understood that either or both of the posts may be hollow and/or have tiltable joints, although the elastic means is preferably in the other post from the one detachably connecting the flag. Furthermore, either or both of the posts may be provided with anchoring means.

There is described above the principles of this invention in connection with specific apparatus, it is to be clearly understood that this description is made only by way of example and not as a limitation to the scope of this invention.

What is claimed is:

1. A slalom gate having a pair of parallel gate posts and a flag connected between the upper ends of said posts, the improvement comprising at least one hollow post and elastic cable means for connecting an edge of said flag to said hollow gate post, said cable extending down through said hollow post from said flag and being anchored near the lower end of said post.

2. A slalom gate according to claim 1 wherein at least one of said gate posts has a tiltable joint near its lower end.

3. A slalom gate according to claim 1 wherein said flag is rectangular.

4. A slalom gate according to claim 1 wherein said flag contains a receptacle for detachably fastening said flag to one of said posts.

5. A slalom gate according to claim 1 wherein said flag is rectangular and has a sleeve along one vertical edge thereof for removably fitting over the upper end of one of said posts.

6. A slalom gate according to claim 1 wherein said flag is rectangular and said elastic means is attached to the upper and lower corners of said flag adjacent said hollow post.

7. A slalom gate according to claim 1 wherein at least one of said posts includes means for anchoring the lower end of said post in snow and ice.

8. A slalom gate having a pair of parallel gate posts and a rectangular flag connected between the upper ends of said posts, the improvement comprising at least one hollow post and elastic cable means attached to the upper and lower corners of said flag and inside said hollow past.

9. A slalom gate according to claim 8 wherein one of said posts is hollow and said elastic means is in the form of a cable which extends down through said hollow post from said flag and is anchored near the lower end of said post.

10. A slalom gate according to claim 9 wherein at least one of said gate posts has a tiltable joint near its lower end.

11. A slalom gate according to claim 9 wherein said flag is rectangular.

12. A slalom gate according to claim 9 wherein said flag contains a receptacle for detachably fastening said flag to one of said posts.

13. A slalom gate according to claim 9 wherein said flag is rectangular and has a sleeve along one vertical edge thereof for removably fitting over the upper end of one of said posts.

14. A slalom gate according to claim 9 wherein one of said posts is hollow and said elastic means is in the form of a cable which extends down through said hollow post from said flag and is anchored near the lower end of said post.

15. A slalom gate according to claim 9 wherein at least one of said posts includes means for anchoring the lower end of said post in snow and ice.

* * * * *